US007771550B2

(12) United States Patent
Halander et al.

(10) Patent No.: US 7,771,550 B2
(45) Date of Patent: Aug. 10, 2010

(54) METHOD AND SYSTEM FOR MANUFACTURE AND DELIVERY OF AN EMULSION EXPLOSIVE

(75) Inventors: John B. Halander, Salt Lake City, UT (US); Casey L. Nelson, Murray, UT (US); Clark D. Bonner, West Jordan, UT (US)

(73) Assignee: Dyno Nobel, Inc., Salt Lake City, UT (US)

( * ) Notice: Subject to any disclaimer, the term of this patent is extended or adjusted under 35 U.S.C. 154(b) by 161 days.

(21) Appl. No.: 11/246,557

(22) Filed: Oct. 7, 2005

(65) Prior Publication Data

US 2007/0277916 A1 Dec. 6, 2007

(51) Int. Cl.
*C06B 31/00* (2006.01)
*D03D 23/00* (2006.01)
*D03D 43/00* (2006.01)

(52) U.S. Cl. ..... 149/45; 149/109.4; 149/109.6

(58) Field of Classification Search ..... 149/109.6, 149/45, 109.4
See application file for complete search history.

(56) References Cited

U.S. PATENT DOCUMENTS

| | | | | |
|---|---|---|---|---|
| 4,259,977 | A | | 4/1981 | Brockington |
| 4,273,147 | A | | 6/1981 | Olney |
| 4,461,660 | A | | 7/1984 | Binet et al. |
| 4,491,489 | A | | 1/1985 | Ellis et al. |
| 4,526,633 | A | | 7/1985 | Lawrence et al. |
| 4,572,075 | A | | 2/1986 | Day et al. |
| 4,756,779 | A | | 7/1988 | Matts |
| 4,829,902 | A | | 5/1989 | Sharpe et al. |
| 4,948,440 | A | * | 8/1990 | Cribb et al. ..... 149/109.6 |
| 5,447,090 | A | | 9/1995 | Adams |
| 5,500,062 | A | * | 3/1996 | Chattopadhyay ..... 149/46 |
| 5,610,358 | A | | 3/1997 | Eager et al. |
| 5,686,685 | A | * | 11/1997 | McDonald et al. ..... 86/20.15 |
| 5,712,440 | A | | 1/1998 | Eagar et al. |
| 5,841,055 | A | * | 11/1998 | Hooper et al. ..... 86/20.15 |
| 6,070,511 | A | | 6/2000 | Palmer et al. |
| 6,557,448 | B2 | | 5/2003 | Delagey et al. |
| 2002/0035917 | A1 | | 3/2002 | Delagey et al. |
| 2003/0159610 | A1 | | 8/2003 | Thompson et al. |
| 2004/0055677 | A1 | * | 3/2004 | Filippini et al. ..... 149/46 |

* cited by examiner

*Primary Examiner*—Jerry Lorengo
*Assistant Examiner*—James E McDonough
(74) *Attorney, Agent, or Firm*—Thorpe North & Western LLP

(57) ABSTRACT

A method for manufacture and delivery of an emulsion explosive having a discontinuous oxidizer solution phase, a continuous fuel phase, and an emulsifier, the method comprising: (a) providing an emulsion manufacturing system; (b) conveying an oxidizer solution phase to the emulsion manufacturing system at a pre-determined pressure; (c) conveying a fuel phase to the emulsion manufacturing system at a pre-determined pressure; (d) forming an emulsion from the oxidizer solution and the fuel phases using only a portion of the pre-determined pressures so as to provide a usable residual pressure after the formation of the emulsion; and (e) utilizing the residual pressure to non-mechanically deliver the emulsion to a pre-determined location.

30 Claims, 6 Drawing Sheets

METHOD AND SYSTEM FOR MANUFACTURE AND DELIVERY OF AN EMULSION EXPLOSIVE

BACKGROUND AND RELATED ART

The present invention relates generally to explosives and explosive delivery systems, and more particularly to a method and system for manufacturing, sensitizing, and delivering an emulsion explosive, either on-site, in a plant, or to another intended location.

On-site explosive emulsion manufacturing and delivery systems are known in the art. These systems utilize various fuel and oxidizer solution phase ingredients, along with various sensitizers, density reducing agents and other ingredients, to form an emulsion explosive. The system used to form the emulsion and to prepare it for delivery typically comprises various combinations of mechanical pumps, mixers, and other systems. In addition, once the emulsion is formed, a mechanical delivery pump, such as a progressive cavity pump, is required to actually deliver the emulsion. The mechanical delivery pump receives the formed emulsion and functions to mechanically convey the emulsion to the intended location, such as down a borehole.

Typically, at the point of delivery, the emulsion is sensitized or is becoming sensitized as an emulsion explosive. Therefore, any mechanical input into the emulsion explosive, such as the mechanical input from a delivery pump, undesirably increases the risks involved in the delivery. In addition, the addition of a delivery pump significantly increases the cost in conveying the emulsion explosive to the intended location.

SUMMARY

In light of the problems and deficiencies inherent in the prior art, the present invention seeks to overcome these by providing an emulsion manufacturing and delivery system, wherein a pumpless delivery system is used to convey or deliver the final emulsion product.

In accordance with the invention as embodied and broadly described herein, the present invention features a method for manufacture and delivery of an emulsion explosive having a discontinuous oxidizer solution phase, a continuous fuel phase, and an emulsifier, the method comprising: (a) providing an emulsion manufacturing system; (b) conveying an oxidizer solution phase to the emulsion manufacturing system at a pre-determined pressure; (c) conveying a fuel phase to the emulsion manufacturing system at a pre-determined pressure; (d) forming an emulsion from the oxidizer solution and the fuel phases using only a portion of the pre-determined pressures so as to provide a usable residual pressure after the formation of the emulsion; and (e) utilizing the residual pressure to non-mechanically deliver the emulsion to a pre-determined location.

The present invention also features a method for forming and delivering an emulsion explosive having a discontinuous oxidizer solution phase, a continuous fuel phase, and an emulsifier, preferably as part of the fuel phase, wherein the method comprises: (a) conveying an oxidizer solution phase into a mixing chamber at a pre-determined pressure; (b) conveying a fuel phase into the mixing chamber, also at a pre-determined pressure; (c) providing an emulsifier in the mixing chamber; (d) causing, non-mechanically, the fuel phase and at least a portion of the oxidizer solution phase to impinge one another with sufficient force to form an emulsion in the presence of the emulsifier; (e) shearing, non-mechanically, the emulsion for further refinement purposes and to obtain a desired viscosity; and (f) delivering, non-mechanically, the emulsion to a pre-determined location by utilizing a residual pressure from the steps of conveying, causing and shearing, the residual pressure being capable of delivering the emulsion to the pre-determined location without the need for additional mechanical input.

The present invention more specifically features a method for forming and delivering an emulsion explosive having a discontinuous oxidizer solution phase, a continuous fuel phase, and an emulsifier, wherein the method comprises: (a) conveying an oxidizer solution phase through a first nozzle into a mixing chamber; (b) conveying a fuel phase through a second nozzle into the mixing chamber; (c) providing an emulsifier in the mixing chamber; (d) orienting the first and second nozzles in a counter opposed position, such that at least a portion of the oxidizer solution phase and the fuel phase impinge on one another with sufficient force to form a pre-blend emulsion in the presence of the emulsifier; (e) forcing the pre-blend emulsion through a third nozzle; (f) causing the emulsion exiting from the third nozzle to impinge a second portion of the oxidizer solution phase being conveyed through a fourth nozzle with sufficient force to form a more oxygen-balanced emulsion; (g) forcing the emulsion through a fifth nozzle to thicken and refine the emulsion; (h) shearing the emulsion to achieve a desired viscosity and to form an emulsion product ready for delivery; and (i) delivering the emulsion product to a pre-determined location, the steps of conveying occurring at sufficient pressure so as to effectuate the steps of orienting, forcing, and shearing, as well as to provide a residual pressure capable of delivering the emulsion product to a pre-determined location without the need for additional mechanical input.

The present invention further features a system for manufacture and delivery of an emulsion comprising: (a) an emulsion manufacturing system; (b) a first pressure source configured to convey an oxidizer solution phase to the emulsion manufacturing system at a pre-determined pressure; (c) a second pressure source configured to convey a fuel phase to the emulsion manufacturing system, the emulsion manufacturing system using only a portion of the pre-determined pressure to form an emulsion from the oxidizer solution and fuel phases so as to provide a usable residual pressure; and (d) a non-mechanical delivery system configured to utilize the residual pressure to deliver the emulsion product to a pre-determined location.

The present invention still further features a system for forming and delivering an emulsion comprising: (a) a first pressure source configured to convey an oxidizer solution phase to a first mixing chamber; (b) a second pressure source configured to convey a fuel phase to the first mixing chamber, the fuel phase including an emulsifier; (c) means for blending, non-mechanically, at least a portion of the oxidizer solution phase with the fuel phase, wherein the oxidizer solution phase is caused to impinge the fuel phase within the first mixing chamber and with sufficient force to form an emulsion in the presence of the emulsifier; (d) means for blending, non-mechanically, the emulsion with a second portion of the oxidizer solution phase, wherein the emulsion is caused to impinge the second portion of the oxidizer solution phase within a second mixing chamber with sufficient force and energy to form a more oxygen-balanced emulsion; (e) means for refining and treating the emulsion to form an emulsion product ready for delivery; and (f) a non-mechanical delivery system configured to deliver the emulsion product to a pre-determined location using a residual pressure from the first and second pressure sources.

In one exemplary embodiment, means for blending, non-mechanically, at least a portion of the oxidizer solution phase with the fuel phase comprises: (i) a first nozzle configured to convey the oxidizer solution phase; and (ii) a second nozzle configured to convey the fuel phase, the first and second nozzles being oriented in a counter opposite position with respect to one another so as to cause the oxidizer solution to impinge the fuel phase.

In another exemplary embodiment, means for blending, non-mechanically, at least a portion of the oxidizer solution phase with the fuel phase comprises a static mixer.

In still another exemplary embodiment, means for blending, non-mechanically, at least a portion of the oxidizer solution phase with the fuel phase comprises a static mixer and nozzle combination, wherein the phases are deflected off of a surface for indirect mixing.

In one exemplary embodiment, means for blending, non-mechanically, the emulsion with a second portion of the oxidizer solution phase comprises: (i) a third nozzle configured to convey the emulsion; and (ii) a fourth nozzle configured to convey a second portion of the oxidizer solution phase, the third and fourth nozzles being oriented in a counter opposing position so as to cause the emulsion to impinge the second portion of the oxidizer solution phase within the second mixing chamber. Similar to above, means for blending, non-mechanically, the emulsion with a second portion of oxidizer solution may comprise a static mixer or a static mixer and nozzle combination.

In one exemplary embodiment, means for refining comprises a fifth nozzle configured to receive the emulsion from the second mixing chamber, wherein the fifth nozzle functions to refine the emulsion to increase its viscosity for delivery.

In one exemplary embodiment, means for refining the emulsion comprises a sixth nozzle configured to mix a density-reducing agent introduced into the emulsion so as to form a plurality of gas bubbles therein. The density-reducing agent functions to reduce the density of and sensitize the emulsion prior to and during delivery.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

DETAILED DESCRIPTION OF EXEMPLARY EMBODIMENTS

Figure 1:
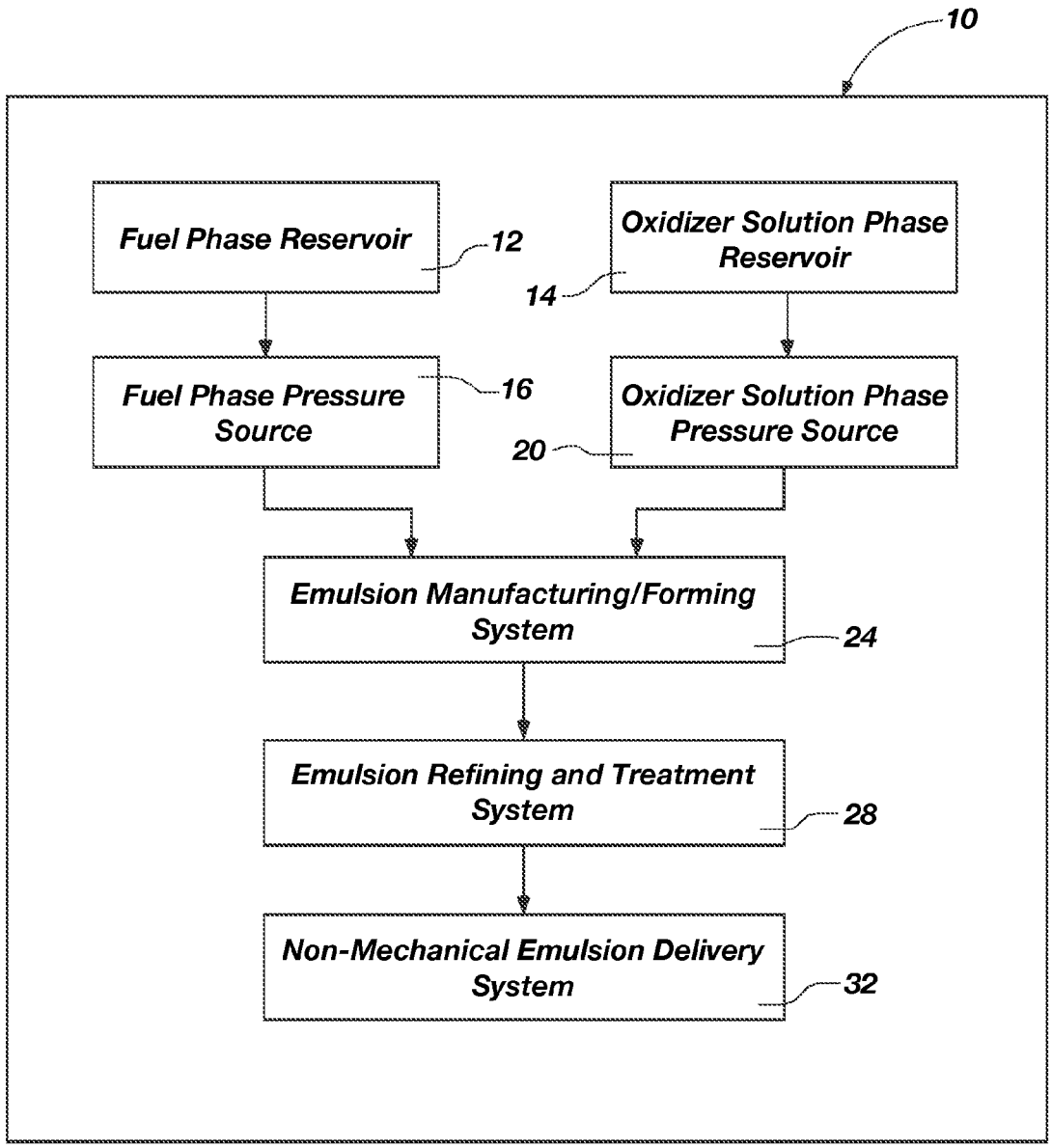
FIG. 1 illustrates a block diagram of a general emulsion manufacturing and pumpless delivery system, according to one exemplary embodiment of the present invention.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention, as represented in FIGS. 1 through 6, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes a method and system for manufacturing an explosive emulsion product on-site or in a plant, wherein the emulsion explosive comprises a discontinuous oxidizer solution phase, a continuous fuel phase, and an emulsifier. The present invention further describes a method and system for delivering the manufactured emulsion using the residual pressure from the manufacture of the emulsion, thus providing a pumpless delivery system, wherein a mechanical pump or other structure is eliminated and not required for delivery of the emulsion product to an intended location.

The present invention provides several significant advantages over prior related emulsion manufacturing and delivery systems, some of which are recited here and throughout the following more detailed description. Each of the recited advantages will be apparent in light of the detailed description set forth below, with reference to the accompanying drawings. These advantages are not meant to be limiting in any way. Indeed, one skilled in the art will appreciate that other advantages may be realized, other than those specifically recited herein, upon practicing the present invention. One particular advantage is the ability to deliver an emulsion product using a residual pressure remaining from the emulsion manufacturing and refining processes. This allows expensive mechanical pumps and other equipment used with such pumps to be eliminated. Stated differently, the present invention contemplates a pumpless delivery system as taught herein.

Preliminarily, the term "pumpless," as used herein, shall be understood to mean a pumpless delivery system, and more specifically, a delivery system that does not utilize a separate mechanical pump on the formed emulsion product at the delivery stage. Indeed, by pumpless, it is intended that the finished emulsion product or emulsion explosive ready for delivery is not fed or otherwise conveyed into a mechanical delivery system, such as a pump, but is instead delivered using only the residual pressure remaining in the system after all manufacturing and refining processes have taken place. The delivery system is operably configured to extract and use the residual pressure to deliver the emulsion. Thus, although the initial conveying systems used to convey the various oxidizer solution phase and fuel or fuel phase to the manufacturing system may comprise mechanical pumps or some other mechanical conveyance means, such pumps are only used on raw materials (e.g., the oxidizer solution and fuel phases), and therefore, the actual delivery system does not comprise any mechanical delivery means, but instead utilizes the residual pressure in the system.

The term "impinge," as used herein, shall be understood to mean the physical coming together of two or more input streams for mixing or blending purposes. Thus, two or more input streams may directly or indirectly impinge one another. An example of direct impingement may comprise two counter-opposing nozzles, wherein the nozzles are oriented such that the streams exiting from each nozzle are caused to impact one another as they exit the nozzle openings. An example of indirect impingement may comprise a static mixer, wherein two or more streams are caused to mix with each other as they come in contact with the stators of the static mixer. Examples of streams that may impinge one another include an oxidizer solution phase and a fuel phase, an oxidizer solution phase and a fuel in the presence of a directly introduced emulsifier, an emulsion and a second portion of oxidizer solution phase, and others.

With reference to FIG. 1, illustrated is a block diagram of a present invention system for manufacturing and delivering an emulsion product or emulsion explosive (hereinafter emulsion manufacturing and delivery system 10), according to one exemplary embodiment of the present invention. The emulsion manufacturing and delivery system 10 comprises a first or a fuel or fuel phase pressure source 16 in fluid communication with a fuel or fuel phase reservoir 12 that is configured to supply a fuel or fuel phase to the fuel or fuel phase pressure source 16, and a second or an oxidizer solution phase pressure source 20 in fluid communication with an oxidizer solution phase reservoir 14 that is configured to supply an oxidizer solution phase to the oxidizer solution phase pressure source 20. Each of the first and second pressure sources 16 and 20 may be electrically coupled to and powered by a power source to provide a pressure. Alternatively, the first and second pressure sources 16 and 20 may be configured to provide hydraulic or pneumatic pressure, as well as pressure using gravity.

More specifically, the first and second pressure sources 16 and 20 are configured to provide a high pressure conveyance of the fuel or fuel phase and oxidizer solution phase, respectively, such that a residual pressure remains to deliver a formed emulsion product to an intended or pre-determined location. In one exemplary embodiment, the first and second pressure sources 16 and 20 may comprise mechanical pumps capable of conveying the fuel or fuel phase and oxidizer solution phase at pre-determined pressures and flow rates. In another exemplary embodiment, the first and second pressure sources 16 and 20 may comprise pneumatic pressure vessels configured to do the same. In still another exemplary embodiment, the first and second pressure sources 16 and 20 may comprise a system whereby the fuel or fuel phase and oxidizer solution phase are each released from an elevated location, thus being conveyed by gravity. The gravity system is also preferably configured to convey these at pre-determined pressures and flow rates. The pre-determined pressure will be sufficient so as to provide a usable residual pressure for delivery of the final emulsion product.

The first and second pressure sources 16 and 20 are specifically configured to convey a fuel or fuel phase and an oxidizer solution phase, respectively, to an emulsion manufacturing or forming system 24 configured to form an emulsion explosive or emulsion product, wherein the emulsion product comprises a discontinuous oxidizer solution phase and a continuous fuel phase. The emulsion manufacturing system 24 is preferably a non-mechanical system, which means none of the various components or systems making up the emulsion manufacturing system 24 utilize mechanical dynamics. This is advantageous in that none of the emulsion is subjected to mechanical input while being formed. The emulsion manufacturing system 24 comprises one or more blending systems configured to mix or blend the fuel or fuel phase with the oxidizer solution phase to form an emulsion in the presence of an emulsifier.

It is specifically noted herein that the present invention contemplates, in one preferred exemplary embodiment, the fuel including or containing the emulsifier, thus existing as a fuel phase. The present invention also contemplates, in another exemplary embodiment, the fuel not including the emulsifier. In this embodiment, the emulsifier may be introduced directly into emulsion manufacturing system, either upstream of or directly into the mixing chamber at the time the fuel (not fuel phase as no emulsifier is present) impinges the oxidizer solution phase. The initial introduction of the emulsifier may be at any pre-determined location, including directly into the mixing chamber, or at another location in which it is subsequently directed to the mixing chamber. In both of these or other obvious embodiments, the emulsion manufacturing system is configured to cause the fuel to mix with the oxidizer solution phase in the presence of the emulsifier to form an emulsion. The preferred method is to contain the emulsifier in the fuel, thus causing the fuel to exist as a fuel phase. As such, much of the following discussion will be directed towards the embodiment in which the emulsifier is contained within the fuel, wherein the fuel is a fuel phase.

Once the emulsion is formed, or even during its formation from a first state to a final product state ready to be delivered, the emulsion may undergo various refinements and/or treatments in the emulsion refinement and treatment system 28. For example, the emulsion may be subjected to additional oxidizer solution to balance the oxygen therein, in the event the oxidizer solution phases are split to simplify the formation of the emulsion. The emulsion may also be sheared to thicken the emulsion (i.e., decrease the droplet size of the oxidizer solution phase) and to obtain a desired viscosity. The emulsion may further have a trace element introduced therein, such as a density reducing agent, to sensitize the emulsion. To aid in its delivery, a water ring may further be placed around the emulsion. Indeed, there are many refinements and treatments that the emulsion may undergo prior to or during its delivery. Those recited herein, and others, will be apparent to one skilled in the art.

After the emulsion has been formed and it is in its final product state, the emulsion is ready for delivery by the pumpless emulsion delivery system 32. As will be more specifically described below, the emulsion delivery system 32 is a non-mechanical system that utilizes pressure and flow velocity to deliver the emulsion, which pressure is a residual pressure from the first and second pressure sources 16 and 20. Unlike prior related systems, the present invention delivery system 32 does not contain an emulsion pump, nor any similar or equivalent mechanical system or device, for pumping or mechanically conveying the emulsion to the pre-determined location. Rather, as stated, the first and second pressure sources 16 and 20 are configured to convey the phases at pre-determined pressures, which are sufficiently high so as to supply or make available pressures that are usable by the emulsion manufacturing system 24 to form the emulsion, as well as the emulsion refinement and treatment system 28 to refine the emulsion. In addition, and unlike prior related systems that provide some type of mechanical input to deliver the emulsion product, the present invention contemplates operating the system at sufficiently high pressures, such that there exists a residual pressure usable by the emulsion delivery system 32 to deliver the emulsion to the intended, pre-determined location without the need for additional mechanical input. Therefore, the delivery system 32 is configured to provide non-mechanical delivery of the emulsion, which, as will be discussed below, is advantageous over prior related mechanical-type delivery systems, such as those utilizing one or more pumps to convey the final emulsion product to the intended location.

The emulsion manufacturing and delivery system 10 is configured to comprise an initial pressure at each of the first or fuel phase and second or oxidizer solution phase pressure sources 16 and 20. Various pressure drops occur within the system as these phases are conveyed and caused to form an emulsion. Other pressure drops occur during refinement and treatment of the emulsion. However, the system 10 is configured so that the pressure drops are not sufficient to exhaust the pressure prior to supplying the emulsion to the delivery system 32. Stated differently, the system 10 is configured with a sufficient amount of initial pressure so that after each pressure drop that occurs prior to delivery, there remains a residual pressure sufficient to effectuate delivery of the final emulsion product to the intended, pre-determined location, thereby making the delivery system a pumpless or non-mechanical delivery system as defined herein. Providing a residual pressure at the delivery stage for delivery purposes functions to enable non-mechanical, pressure induced delivery of the final emulsion product, which also functions to eliminate the need for a mechanical delivery system or device, such as an emulsion pump (e.g., a progressive cavity pump), common in many prior related systems. By eliminating the emulsion pump, a corresponding safety shut down system generally required on all such pumps may also be eliminated. By eliminating these components, there is no mechanical input to an explosive product, thus making the delivery of the explosive emulsion safer. In addition, significant cost savings are made possible.

Figure 2:
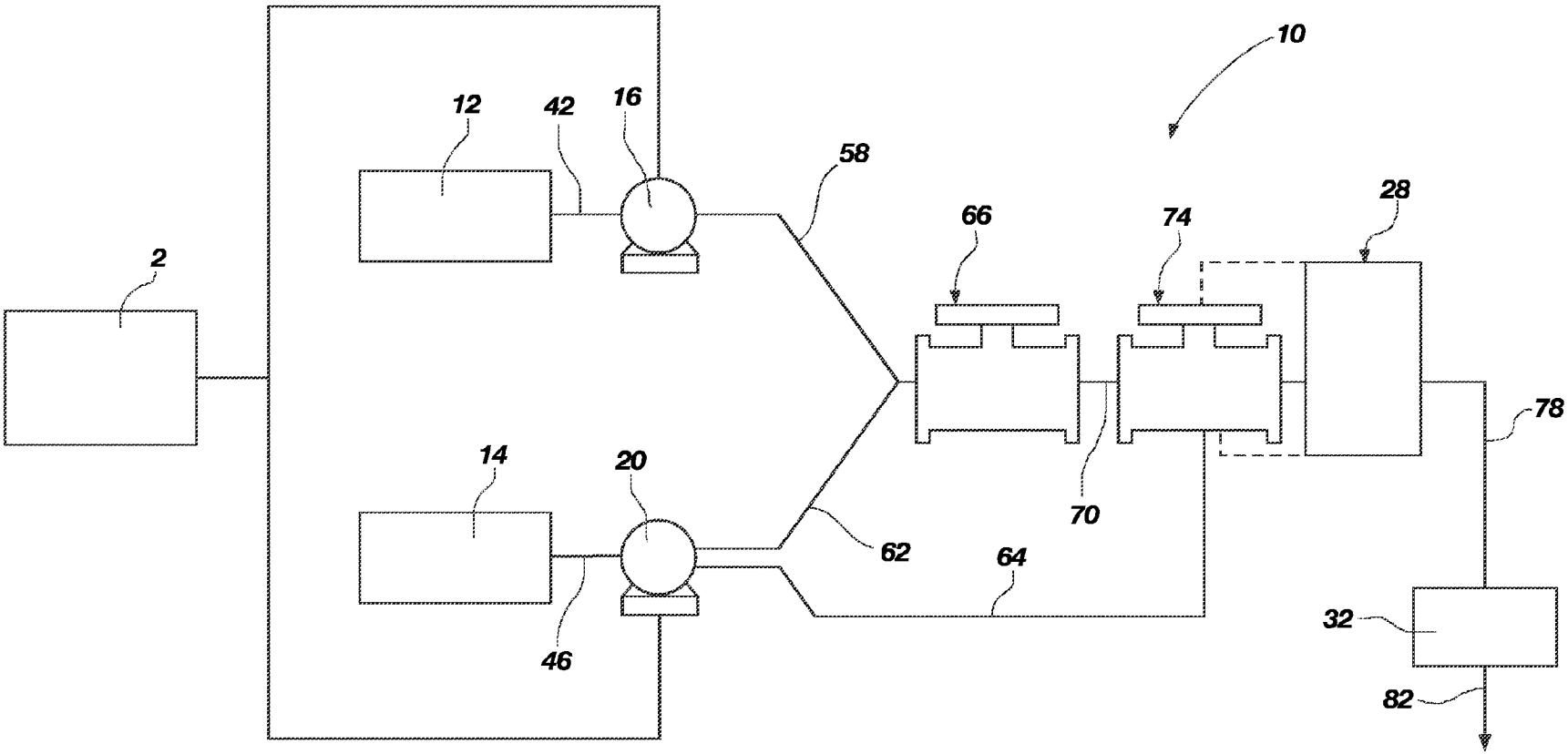
FIG. 2 illustrates a general schematic diagram of an emulsion manufacturing and pumpless delivery system, according to one exemplary embodiment of the present invention.

With reference to FIG. 2, illustrated is a general emulsion manufacturing and delivery system 10, according to one exemplary embodiment of the present invention. The emulsion manufacturing and delivery system 10 comprises a first pressure source in the form of a fuel phase pump 16 that is in fluid communication with a fuel phase reservoir 12 configured to supply a fuel phase to the fuel phase pump 16 via delivery line 42. A second pressure source in the form of an oxidizer solution phase pump 20 is in fluid communication with an oxidizer solution reservoir 14 configured to supply a oxidizer solution phase to the oxidizer solution phase pump 20 via delivery line 46. Each of the pumps 16 and 20 may be electrically, pneumatically, or hydraulically coupled to and powered by a power source 2.

The fuel phase pump 16 is configured to convey fuel phase, at a predetermined pressure, through delivery line 58 to a first blending system 66. Likewise, oxidizer phase pump 20 is configured to convey at least a portion of oxidizer solution phase, also at a pre-determined pressure, to the first blending system 66 through delivery line 62, as well as, if desired, to a second optional blending system 74 via delivery line 64. Indeed, one exemplary system may split the oxidizer solution phase 60/40, with 40% going to the first blending system 66 and 60% going to the second blending system 74. Of course, the percentage split may vary from system to system, or as needed, and thus the 60/40 split recited here should not be construed as limiting in any way.

The first and second blending systems 66 and 74 are configured to mix the oxidizer solution phase with the fuel phase to form an emulsion. The first blending system 66 is configured with means for blending, non-mechanically, at least a portion of the oxidizer solution phase with the fuel phase, wherein the oxidizer solution phase is caused to impinge the fuel phase within a first mixing chamber and with sufficient force to form an emulsion in the presence of an emulsifier. This is advantageously done using one or more non-mechanical means. The formed emulsion is a fuel rich, pre-blend emulsion as only a portion of the oxidizer solution phase is allowed to mix with the fuel phase. The non-mechanical means for blending the oxidizer solution and fuel phases may comprise counter-opposing nozzles, static mixers, combinations of these, and other devices or assemblies capable of causing the fuel phase to impinge and mix with the oxidizer solution phase to form the fuel-rich emulsion. Each of these is discussed in greater detail below. In essence though, the first blending system 66 provides sufficient pressure, and therefore energy, so that as the two phases impinge one another, an emulsion is created or formed. The required force or pressure needed to create the emulsion will depend upon several factors, such as the system configuration, the size of the components operable within the system, the temperature, the emulsifier used, etc. Once the emulsion is formed, it may go through several refinements to achieve a final emulsion product ready for delivery. Several exemplary refinement procedures are also discussed below.

The second blending system 74 is in fluid communication with the first blending system 66 to receive the fuel rich, pre-blend emulsion formed therein. The second blending system 74 is also in fluid communication with the oxidizer solution phase pump 20 to receive the second or remaining portion of oxidizer solution phase not conveyed to the first blending system 66. The second blending system 74 is therefore configured with means for blending, non-mechanically, the fuel rich, pre-blend emulsion with a second portion of the oxidizer solution phase, wherein the fuel rich, pre-blend emulsion is caused to impinge the second portion of the oxidizer phase within a second mixing chamber with sufficient force and energy to form a more oxygen-balanced emulsion than the fuel-rich emulsion formed in the first blending system 66. The non-mechanical means for blending the fuel rich, pre-blend emulsion with the second portion of the oxidizer solution may likewise comprise counter-opposing nozzles, static mixers, combinations of these, and other devices or assemblies.

It is noted herein that the first and second blending systems 66 and 74 are unlike conventional blending systems or devices used in prior related systems, which are mechanical in nature. Rather, the blending systems of the present invention are intended to be non-mechanical, and more specifically, are those capable of receiving the fuel and oxidizer solution phases under high pressure and causing the fuel phase to impinge the oxidizer solution phase to form an emulsion, and the emulsion to impinge the remaining portion of oxidizer solution phase, using only the pressure within the system as provided by the pressure sources. In addition, depending upon the configuration of the blending systems 66 and 74, impingement of the various fuel and oxidizer solution phases with each other, or the fuel rich emulsion with the remaining oxidizer solution phase may be direct (such as in the case of counter opposing nozzles in line with one another or on a slight incline) or indirect (such as in the case of a static mixer or a static mixer and nozzle combination where the incoming materials are caused to deflect off one or more surfaces). Again, each of these is discussed in greater detail below.

At some point during the manufacture stages, the emulsion may undergo refinement or treatment to obtain a more suitable emulsion product ready for delivery. The refinement and treatment system 28 functions to perform any needed refining of the emulsion. As can be seen, the emulsion may be partly refined while in the second blending system 74 (illustrated by the phantom lines), or in a separate system altogether. Examples of refining processes are discussed herein.

The delivery system 32 is configured to utilize the residual pressure remaining in the system from the first and second pressure sources to deliver the emulsion to a pre-determined location, such as a borehole or in a plant. Any system capable of non-mechanically conveying or delivering the final emulsion product to the intended location using the residual pressure in the system is contemplated herein.

Figure 3:
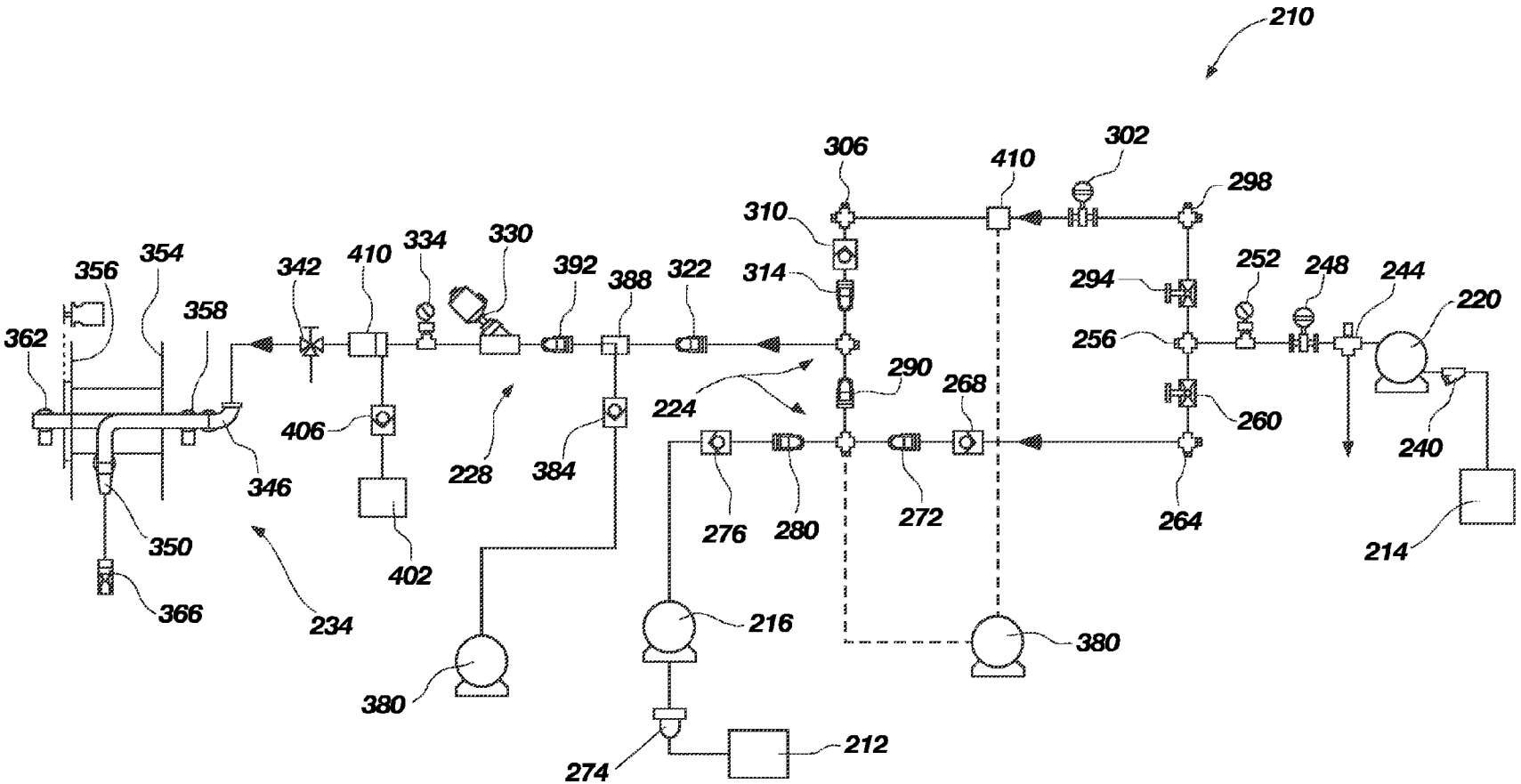
FIG. 3 illustrates a detailed schematic diagram of an emulsion manufacturing and pumpless delivery system, according to one exemplary embodiment of the present invention.
Figure 4:
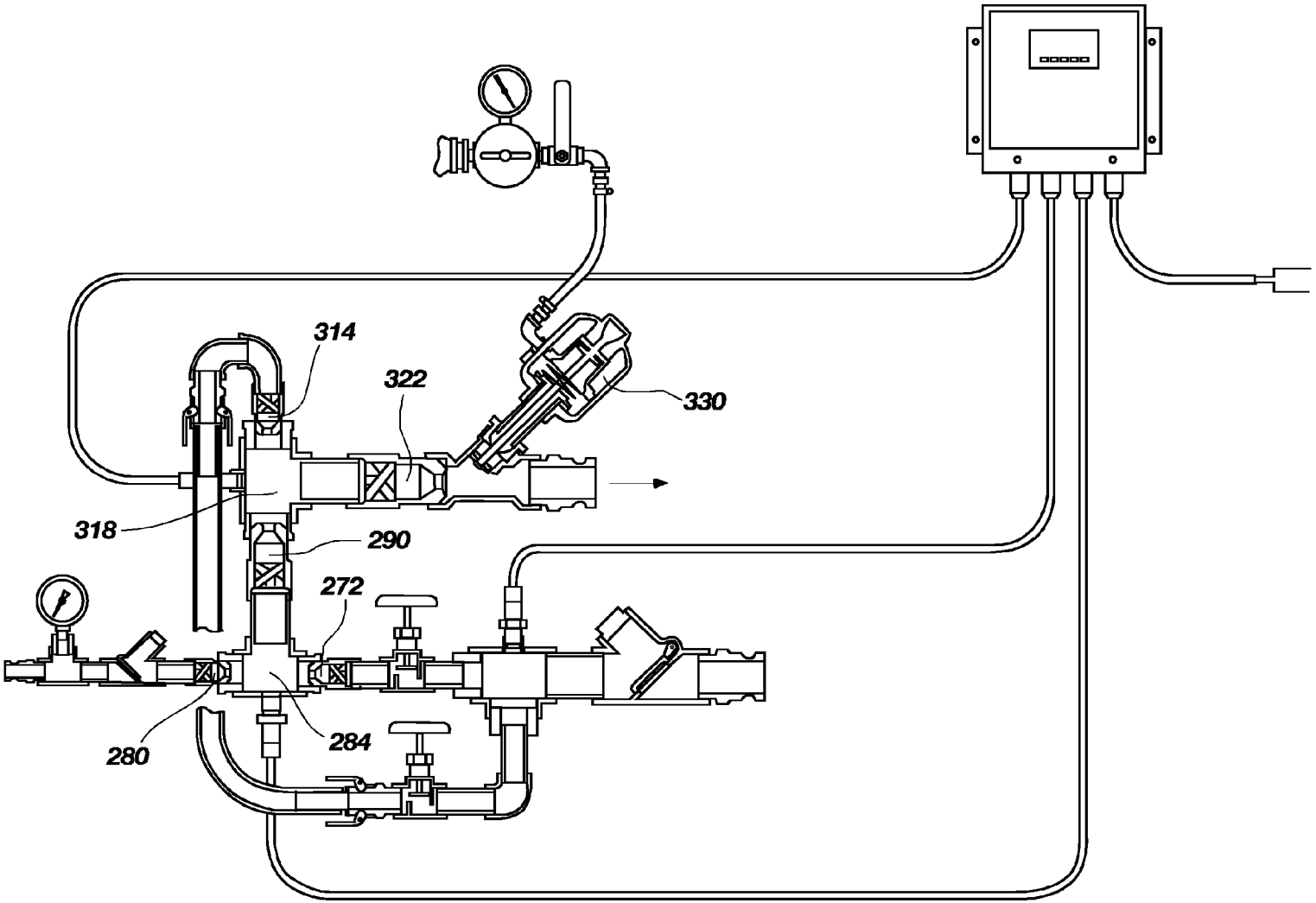
FIG. 4 illustrates a detailed schematic view of a portion of the emulsion manufacturing and pumpless delivery system of FIG. 3.

With reference to FIGS. 3 and 4, illustrated is a specific on-site emulsion manufacturing and delivery system 210 according to one exemplary embodiment of the present invention. The various components shown in this particular embodiment may be housed within and supported by a truck or other vehicle capable of manufacturing and delivering the produced explosive emulsion on-site to the pre-determined location.

As shown, an oxidizer solution phase is supplied from an oxidizer solution phase reservoir 214 to an oxidizer solution pump 220, which is shown as a mechanical pump. Prior to entering the oxidizer solution pump 220, the oxidizer solution phase is passed through a filter 240. The oxidizer solution pump 220 functions to convey, at a high pressure, at least a portion of the oxidizer solution phase to an emulsion manufacturing system 224, and particularly to a first nozzle 272 situated therein. In the exemplary embodiment shown the oxidizer solution phase is divided or split so that a portion is conveyed to the first nozzle 272 and a second portion is conveyed to a fourth nozzle 314 for use in later stages of the emulsion manufacturing process, which purpose is described below. The percent split may vary from system to system, but will typically involve between forty and sixty percent (40%-60%) initially going to the first nozzle 272 and the remaining forty to sixty percent (40%-60%) going to the fourth nozzle 314. A preferred split will comprise forty percent (40%) being conveyed to the first nozzle 272 and the remaining sixty percent (60%) being conveyed to the fourth nozzle 314. Splitting or dividing the oxidizer solution phase functions to facilitate the rapid formation of the emulsion from the fuel and oxidizer solution phases. However, splitting the oxidizer solution phase is not required. It is contemplated that some systems will form the emulsion by causing the fuel phase to simultaneously impinge all of the oxidizer solution phase.

A fuel phase is supplied from a fuel phase reservoir 212 to a fuel phase pump 216, which is also shown as a mechanical pump. As discussed above, in one preferred exemplary embodiment, the fuel includes the emulsifier, and is thus a fuel phase. In another exemplary embodiment, the fuel will not include the emulsifier, but will instead mix with an emulsifier as directly introduced. Prior to entering the fuel phase pump 216, the fuel phase is passed through a filter 274. The fuel phase pump 216 functions to convey the fuel phase to the emulsion manufacturing system 224, and particularly to a second nozzle 280 situated therein. As shown, the first and second nozzles 272 and 280 are oriented in a counter opposing position with respect to one another, such that the oxidizer solution phase exiting the first nozzle 272 is caused to impact or collide with the fuel phase exiting the second nozzle 280, preferably within a mixing chamber, shown as first mixing chamber 284. In other words, the first and second nozzles 272 and 280 are oriented so that the oxidizer solution phase impinges the fuel phase. The first and second nozzles 272 and 280 may or may not comprise stators or static mixers situated therein.

The oxidizer solution pump 220 is configured to convey the oxidizer solution phase at a pre-determined pressure and velocity or flow rate so as to cause the oxidizer solution phase to exit the first nozzle 272 at a sufficiently high velocity so that as it impinges the fuel phase, in the presence of the emulsifier, it does so with sufficient force and pressure, and therefore sufficient energy, to form a pre-blend, fuel-rich emulsion. The necessary energy to form the emulsion may result from the velocity of the two phases as conveyed. The fuel phase pump 216 is also configured to convey the fuel phase at a pre-determined pressure and velocity or flow rate. Thus, the velocity of the two phases should be sufficient to produce the energy required to form the emulsion upon mixing. The velocity of the oxidizer solution phase will typically be much higher than that of the fuel phase. It is noted that the fuel rich, pre-blend emulsion in this particular embodiment is formed non-mechanically, meaning without additional input from a mechanical system or device, such as a blender.

The emulsion formed upon the oxidizer solution and fuel phases exiting the first and second nozzles 272 and 280, respectively, and impinging one another is largely unrefined, or rather is a pre-blend, and is a fuel rich or high fuel concentration emulsion due to the higher concentration of fuel phase being mixed with the oxidizer solution phase. However, as one skilled in the art will recognize, and as discussed above, the oxidizer solution phase is not required to be split prior to impinging the fuel phase to form an emulsion. Indeed, an emulsion may be formed by causing one hundred percent (100%) of the oxidizer solution to impinge or mix with the fuel phase to form an emulsion substantially ready for delivery.

Upon formation, the fuel rich, pre-blend emulsion is forced from the first mixing chamber 284 through a third nozzle 290, which is perpendicular to the first and second nozzles 272 and 280, and which is in fluid communication with the first mixing chamber 284 and/or the first and second nozzles 272 and 280, using energy available within the system from the oxidizer solution and fuel phase pumps 216 and 220. It is noted herein, that the pressure and energy existing within the system used to manufacture and deliver the emulsion is provided by the oxidizer solution and fuel phase pumps 216 and 220. In other words, the pumps 216 and 220 are configured to provide all of the necessary pressure or energy within the system to convey the products used to form the emulsion, as well as to facilitate refining the emulsion to produce an emulsion product. The pressure is pre-determined to be sufficient to perform all of the various stages of processing via the manufacturing and refinement systems 224 and 228. Although various pressure drops occur at the various stages of the manufacturing and the refinement processes, the pumps are configured to account for this and to provide a sufficient residual pressure for delivery of the emulsion after all manufacturing and refinement or treatment steps have been completed. This residual pressure functions to provide a non-mechanical means for delivering the emulsion to an intended location, such as down a borehole.

As the fuel-rich emulsion is conveyed through the third nozzle 290, it is caused to exit into a second mixing chamber 318. The third nozzle 290 may be configured with a static mixer or another type of configuration to introduce shear into the emulsion, thus somewhat thickening and refining the emulsion. Counter opposed to the third nozzle 290 is a fourth nozzle 314 configured to convey the remaining portion of the oxidizer solution phase, as split off from the initial portion of oxidizer solution phase, into the second mixing chamber 318 where it is caused to impact or collide with the fuel-rich emulsion. In other words, the fuel-rich emulsion is caused to impinge the remaining portion of the oxidizer solution phase within the second mixing chamber 318. Similarly, the second or remaining portion of the oxidizer solution phase and the fuel-rich emulsion are conveyed with sufficient pressure and energy, such that upon impinging one another in the second mixing chamber 318, a more oxygen-balanced emulsion is formed.

After the fuel-rich emulsion and the remaining oxidizer solution phase impinge one another in the second mixing chamber 318, the resulting more oxygen-balanced emulsion may be caused to exit therefrom and to enter the refinement and treatment system 228. More specifically, initial stages of refinement involve the more oxygen-balanced emulsion being forced through various nozzles for further refinement purposes, such as to thicken the emulsion, to stabilize it, and to increase or otherwise adjust its viscosity. However, depending upon the configuration of the system used to form the emulsion, further refinement may or may not be necessary. Indeed, the components and system parameters used to form the emulsion may produce a final emulsion product ready for delivery, without the need for additional refinement.

In one exemplary embodiment, a fifth nozzle 322 may be included and oriented perpendicular to the third and fourth nozzles 290 and 314. The more oxygen-balanced emulsion may be forced through the fifth nozzle 322, wherein the emulsion is somewhat thickened and its viscosity increased. In the embodiment shown, the fifth nozzle 322 comprises a static mixer to introduce additional shear into the emulsion. Other refinement and treatment processes within the refinement and treatment system 228 are discussed below.

In another exemplary embodiment, after being forced through the fifth nozzle 322, the emulsion may be introduced or conveyed into a viscosity adjuster or shear valve 330, such as a Burkert valve. The purpose of the shear valve 330 is to perform a final refining of the emulsion, thereby forming a final emulsion product, or emulsion explosive, ready for delivery to perform its intended explosive function. The shear valve 330 is configured to introduce additional shear into the emulsion for a sufficient time to achieve or obtain a desired viscosity. Other types of systems, valves, or devices, other than a shear valve, may be used to refine the formed emulsion and to form a final emulsion product, as will be recognized by those skilled in the art. For example, the shear valve may be replaced by a series of nozzles (that may or may not be of different size or configuration) having static mixer configurations therein.

As with other process steps, and if necessary, the emulsion is caused to exit the fifth nozzle 322 and to enter and pass through the shear valve 330 using the existing pressure within the system. In other words, no mechanical input is required to move or convey the emulsion into and through the shear valve 330.

After exiting the shear valve 330, the emulsion product is ready for delivery by the delivery system 234. In the embodiment shown, the delivery system 234 comprises a delivery hose 346 in fluid communication with the shear valve 330 via a delivery line. The delivery hose 346 comprises an opening 350 and a sufficient length so as to be able to deliver the emulsion product to the intended or predetermined location, such as a borehole, a package, or a receptacle. The delivery hose is supported by a hose reel 354 mounted to a support, such as a truck (not shown), configured to provide the hose reel 354 to be rotated to wind and unwind the delivery hose 346. A common crank 356 may be used to rotate the hose reel 354.

As discussed above, advantageously, the delivery system 234 utilizes the residual pressure existing within the system to deliver the emulsion product to the intended location. The amount of residual pressure available for use in delivery depends upon system constraints, the initial pressures within the pressure sources or pumps supplying the fuel and oxidizer solution phases, and the number of pressure drops occurring within the system prior to delivery. In essence, the system is intended to be designed so that a residual pressure remains. In such a case, the pressure is not exhausted during the manufacture and refinement processes. In the embodiment shown, the initial pressure output of the oxidizer solution phase pump 220 is between 300 and 500 psig. The initial pressure output of the fuel phase pump 216 is between 300 and 500 psig. After all pressure drops due to the work in manufacturing and refining the emulsion, the residual pressure is between 50 and 250 psig, which is sufficient to delivery the final emulsion product the required distance down the borehole via the delivery hose 346. In a preferred embodiment, the fuel phase and oxidizer solution phases are running at about 350 psig. The pressure drops within the system total 200-250 psig, so that there is a usable residual pressure of 100-150 psig available to delivery the emulsion product.

FIG. 3 further illustrates additional refinement and treatment systems. For instance, after exiting the fifth nozzle 322 and prior to being conveyed into the shear valve 330, the emulsion may be sensitized as an explosive. In this process step, a density-reducing agent is introduced into the system to reduce the density of the emulsion and to form bubbles in the emulsion, thereby increasing its sensitivity. A pump 380 may be provided that is configured to convey the density-reducing agent to an injector 388 positioned downstream from the fifth nozzle 322. The injector 388 functions to inject the density-reducing agent into the emulsion exiting from the fifth nozzle 322. A sixth nozzle 392 is used to mix the density-reducing agent with the emulsion prior to it being conveyed into the shear valve 330. The sixth nozzle 392 comprises a static mixer therein to effectuate the mixing of the density-reducing agent with the emulsion. Various types and configurations of mixers may be implemented to cause the density-reducing agent to mix with the emulsion in order to sensitize the emulsion. In any event, the function of the density-reducing agent is to sensitize the emulsion as an explosive by forming tiny gas bubbles therein.

In one exemplary embodiment, the density-reducing agent comprises a trace element in the form of a chemical gassing agent or a variety of chemical gassing agents, each being configured to react with the emulsion once injected therein to form tiny bubbles within the emulsion. Examples of chemical gassing agent(s) include, but are not limited to, nitrites, peroxides, and carbonates.

In another exemplary embodiment, the density-reducing agent comprises a compressed gas. The compressed gas is introduced into the emulsion, whereby doing so functions to introduce bubbles within the emulsion. Examples of compressed gas include, but are not limited to, nitrogen, helium, argon and air.

In the discussion above, the density-reducing agent is introduced downstream from the fifth nozzle 322. The present invention contemplates other injection locations. Specifically, the density-reducing agent may be injected at a location so as to eliminate the need for the sixth nozzle 392. For example, as shown, the pump 380 may be configured to inject the density-reducing agent into the second or remaining oxidizer solution stream prior to its conveyance through the fourth nozzle 314 and into the second mixing chamber 318. Alternatively, the density-reducing agent may be injected directly into the first mixing chamber 284 where all of the fuel phase is combined with at least a portion of the oxidizer solution phase. In these instances, the mixing of the density-reducing agent with the emulsion will be accomplished during the formation and refining stages. Other locations may be suitable to effectively reduce the density of the emulsion. One particular type of injector used to inject the density-reducing agent into the system may comprise a stainless steel sintered exhaust muffler. In addition, the flow rate of the air may be regulated to minimize the amount of spatter.

FIG. 3 still further illustrates a water injector 410 configured to place a water ring about the emulsion product prior to delivery. The water injector 410 is in fluid communication with a water source 402 to receive water therefrom, which may also pass through a check valve 406. The location of the water injector 410 is shown downstream from the shear valve 330 and just prior to when the emulsion product enters the delivery system 234. The water ring is used to aid in the delivery of the emulsion product to the intended location, such as down the borehole, as commonly understood in the art.

It is noted herein that the emulsion manufacturing and delivery system 210 comprises various valves, meters, and gauges to control and monitor the activity within the system. For example, in the delivery line fluidly connecting the oxidizer solution pump 220 to the first nozzle 272 there is a relief valve 244, a flow meter 248, a pressure gauge/transducer 252, a globe valve 260, and a check valve 268. Each of these function to assist system operators in the manufacture and delivery of the emulsion. In the delivery line fluidly connecting the oxidizer solution pump 220 to the fourth nozzle 314 there are many of these same components, as well as a globe valve 294, a flow meter 302, and a check valve 310. There may also be similar components positioned between the shear valve 330 and the delivery system 234, such as pressure gauge/transducer 334 and three-way ball valve 342. Other types of valves, systems, etc., may be incorporated or included in the system as will be recognized by one skilled in the art.

Figure 5:
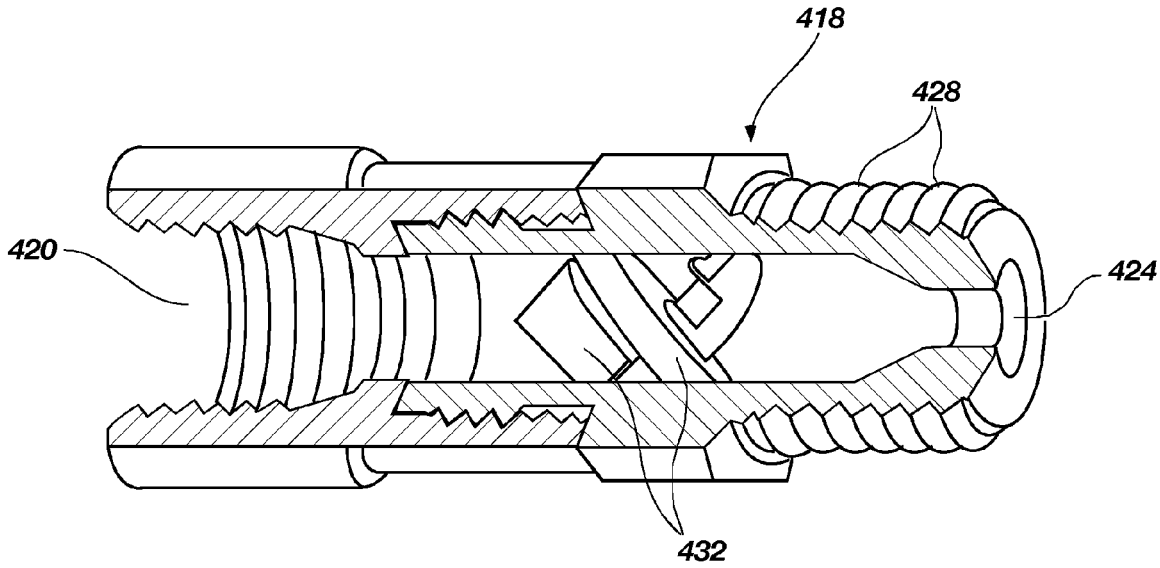
FIG. 5 illustrates a detailed cut-away side view of a nozzle used to refine an emulsion, according to one exemplary embodiment.

With reference to FIG. 5, illustrated is a detailed cut-away view of a nozzle that may be used in the present invention system, according to one exemplary embodiment. It is noted herein that any of the first, second, third, and fourth nozzles described above may be configured similar to the nozzle illustrated in FIG. 5. As shown, the nozzle 418 comprises a central bore 420 and a reduced diameter opening 424 where the emulsion exits. Contained within the central bore 420 is a static mixer 432 configured to cause the emulsion to spin and to introduce shear into the emulsion prior to its exit from the nozzle opening 424. The nozzle 418 may further comprise threading 428 formed on all or a portion of its outer surface to allow the nozzle 418 to be inserted into a support structure to secure the nozzle 418 in place with the opening 424 directed into a mixing chamber.

As will be recognized by one skilled in the art, the size of the above-described nozzle may vary in size and configuration, depending upon its location in the system, the desired flow rate for the various phases, or the formed emulsion passing through them. In addition, the nozzles may be configured without a static mixer configured therein.

The present invention further contemplates other types of non-mechanical mixing and/or blending means both to mix the fuel and oxidizer solution phases to form an emulsion, as well as to refine a formed emulsion. For example, instead of two counter opposed nozzles, one particular embodiment may comprise a static mixer, wherein fuel and oxidizer solution phases are caused to simultaneously enter, and wherein the static mixer functions to form an emulsion from these two phases. In this embodiment, a static mixer may also be used to replace various refining nozzles, such as the fifth and sixth nozzles discussed above. Rather than refining the emulsion using nozzles, the emulsion may be refined using one or more static mixers.

Other embodiments may include a nozzle and static mixer combination. In such an embodiment, the fuel and oxidizer solution phases may be mixed together and fed through a nozzle. The nozzle may inject the mixed phases into a static mixer. In this case, although mixed together, the fuel and oxidizer solution phases will not be mixed sufficiently, or with enough energy, to form an emulsion prior to entering the static mixer.

In still another exemplary embodiment, the oxidizer solution and fuel phases may be fed through separate nozzles aimed at one or more deflection plates supported within a mixing chamber, in which case the oxidizer solution and fuel phases do not directly impinge one another, but instead indirectly impinge one another. The deflector plates may comprise any number and any configuration necessary to form the emulsion.

Figure 6:
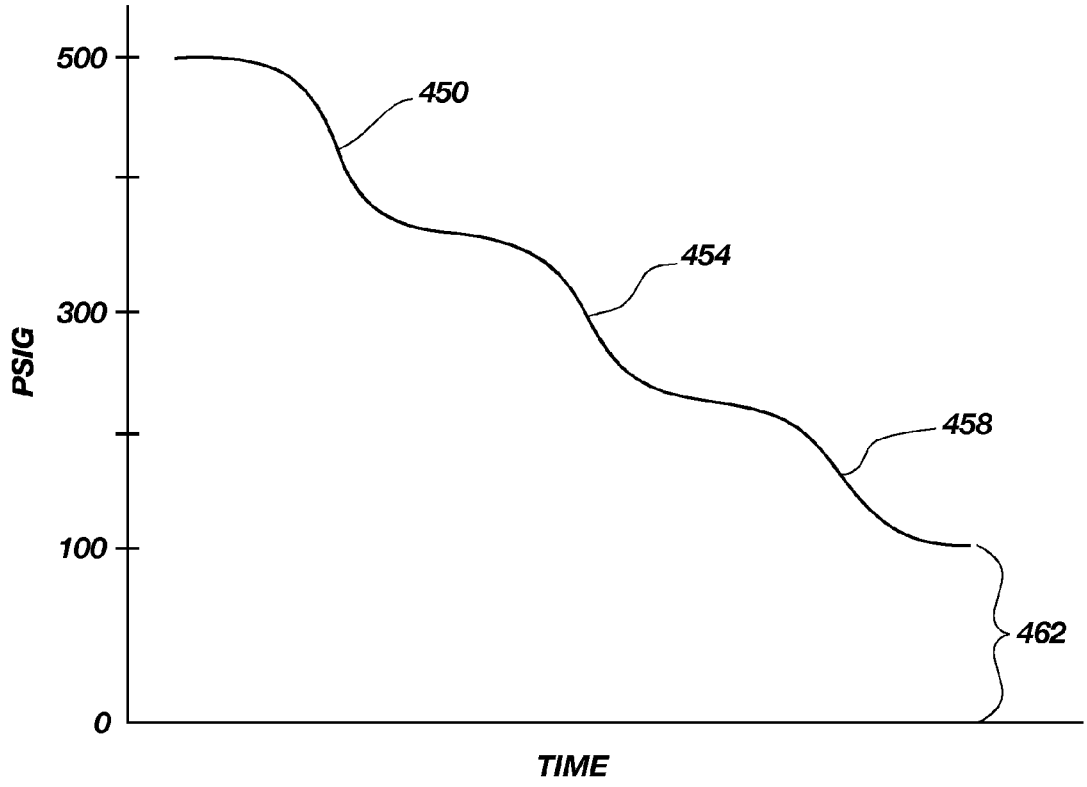
FIG. 6 illustrates a graphical depiction of the pressure level within the system at each stage of manufacturing, and the residual pressure that exists just prior to delivery of the emulsion product.

FIG. 6 illustrates a graphical depiction of the amount of pressure within an exemplary system at each stage, and the residual pressure that exists just prior to delivery of the emulsion product. As shown, the initial pressure within the system is around 500 psig, as provided by the pressure sources conveying the various oxidizer solution and fuel phases. As the emulsion is manufactured and refined, there occurs several changes in pressure, and particularly several pressure drops. However, the initial pressure is configured and designed to be sufficient to provide a residual pressure 462 of around 100 psig at the end of all the manufacturing and/or refinement steps, and just prior to delivery of the emulsion product. The first significant pressure drop 450 occurs within the first blending system where the oxidizer solution phase is mixed with the fuel phase to form the fuel-rich emulsion. The second significant pressure drop 454 occurs in the second blending system where the fuel-rich emulsion is caused to mix with a second or remaining portion of the oxidizer solution phase to form a more oxygen balanced emulsion. Other pressure drops, such as pressure drop 458, occur during refining of the emulsion, such as when it is passed through the shear valve to obtain a desired viscosity. It is noted that the graph in FIG. 6 is intended to illustrate the drop in pressure over time as the emulsion is formed and/or refined. Indeed, there may be additional changes in pressure other than the ones illustrated here. For example, a change in pressure might occur when the emulsion is subjected to a compressed gas to reduce its density.

The following example(s) are illustrative of experiments conducted to create and deliver an emulsion using the present invention method and system. These examples are not intended to be limiting in any way, and should not be construed as such.

EXAMPLE ONE

An emulsion explosive composition was formed at 500 pounds per minute (500 lbs./min.). Fuel phase, with an emulsifier, was pumped through a first nozzle at a 30 pounds per minute (30 lbs./min.) flow rate. A portion of oxidizer solution phase was pumped by a Waukesha oxidizer solution pump through a second nozzle at a 235 pounds per minute (235 lbs./min.) flow rate. The oxidizer solution phase was split to more rapidly and efficiently form the emulsion. The first and second nozzles were oriented in a counter-opposing position with respect to one another so that their outlet ports or nozzle openings were directly facing one another. The initial pressures at each of the fuel phase and oxidizer solution phase pumps caused the fuel phase, with an emulsifier present therein, to impinge a portion of the oxidizer solution phase within a mixing chamber to form a high fuel or fuel-rich emulsion. The high fuel emulsion blend was then forced through a third nozzle oriented perpendicular to the first and second nozzles. A fourth nozzle was oriented in a counter-opposing position with respect to the third nozzle, such that the refined high fuel emulsion being forced through the third nozzle was caused to impinge a second portion of oxidizer solution phase being forced through the fourth nozzle. The second portion of oxidizer solution phase was pumped through the fourth nozzle at 235 pounds per minute (235 lbs./min.). The resulting more oxygen-balanced emulsion was then forced through a fifth nozzle, which was oriented perpendicularly to the third and fourth nozzles, to refine the emulsion by thickening. The product exiting from the fifth nozzle comprised an emulsion explosive. It was discovered that the emulsion at this point had a viscosity of 6500 cP at 85° C. (#6 spindle @ 50 rpm). As such, the emulsion was subjected to a viscosity adjusting apparatus or shear valve (e.g., a Burkert valve), which was positioned in line with and immediately after and parallel to the fifth nozzle. The viscosity adjusting apparatus functioned to thicken the emulsion to a desired viscosity, in which the emulsion was ready for delivery.

EXAMPLE TWO

This Example is similar to Example One. However, the nozzles and flow rates from the above example were sized down from 500 lbs/min. to achieve a 200 pounds per minute (200 lbs/min.) flow rate. In addition, fuel phase, with an emulsifier, was pumped by a gear pump through a first nozzle. Oxidizer solution phase was pumped by a high-pressure diaphragm pump through a second nozzle. The regular fuel phase pump was replaced with the gear pump to achieve the necessary flow rates at pressures to about 500 psig. The replacement of the Waukesha oxidizer solution pump with the high pressure diaphragm pump also provides the capability to deliver the desired flow rates at these elevated pressures.

Again, the first and second nozzles were oriented in a counter-opposing position with respect to one another so that their outlet ports were directly facing one another. The initial pressures at each of the fuel phase and oxidizer solution phase pumps caused the fuel phase, with an emulsifier present therein, to impinge at least a portion of the oxidizer solution phase within a mixing chamber to form a high fuel or fuel-rich emulsion. The high fuel emulsion blend was then forced through a third nozzle oriented perpendicular to the first and second nozzles. A fourth nozzle was oriented in a counter-opposing position with respect to the third nozzle, such that the refined high fuel emulsion being forced through the third nozzle was caused to impinge a second portion of oxidizer solution phase being forced through the fourth nozzle. The resulting emulsion was then forced through a fifth nozzle, which was oriented perpendicularly to the third and fourth nozzles, for further refinement purposes as described herein. The product exiting from the fifth nozzle comprised a form of a final emulsion product or emulsion explosive. It was discovered that the emulsion at this point had a viscosity of 6500 cP at 85° C. (#6 spindle @ 50 rpm). As such, the emulsion was subjected to a viscosity adjusting apparatus or shear valve (e.g., a Burkert valve), which was positioned in line with and immediately after and parallel to the fifth nozzle. The viscosity adjusting apparatus functioned to thicken the emulsion to a desired viscosity.

The elevated pressure resulted in a residual pressure after the emulsion was manufactured and refined and just prior to being delivered. As such, the delivery system used to deliver the emulsion to the borehole was a pressure delivery system that utilized the available residual pressure to convey the emulsion down the borehole.

The following table illustrates the system parameters and results from the conducted experiment set forth in Example Two.

TABLE ONE

| Oxidizer Solution Pump RPM | Oxidizer Solution Flow Rate (lb/min) | Fuel Pump RPM | Fuel Phase Flow Rate (lb/min) | Burkert Pressure | Oxidizer Pump Pressure | Oxidizer Stream # 1 (40%) Pressure | Oxidizer Stream #2 (60%) Pressure | Pre-Burkert Pressure | Viscosity (*k) |
|---|---|---|---|---|---|---|---|---|---|
| 835 | 187 | 877 | 13 | 0 | 170 | 165 | 150 | 55 | 36 |
| " | " | " | 13 | 20 | 230 | 225 | 190 | 115 | 65 |
| " | " | " | 13 | 40 | 345 | 310 | 280 | 200 | 115 |
| " | " | " | 13 | 60 | 380 | 330 | 310 | 230 | 130 |

It is noted, that the viscosity @ 60 psi was #7 @ 20 rpm, all inline pressures are +/−10 psi, and the Oxidizer solution was split into two streams, stream number one and stream number two, with stream number one comprising 40% and stream number two comprising 60%.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are expressly recited. Accordingly, the scope of the invention should be determined solely by the appended claims and their legal equivalents, rather than by the descriptions and examples given above.

What is claimed and desired to be secured by Letters Patent is:

1. A method for manufacturing and delivering an emulsion explosive, said method comprising:

providing a combined and continuous emulsion manufacturing and delivery system;

conveying an oxidizer solution phase to said emulsion manufacturing and delivery system at an initial pre-determined pressure;

conveying a fuel to said emulsion manufacturing and delivery system at an initial pre-determined pressure;

utilizing a portion of said initial pre-determined pressures to form an emulsion explosive from said oxidizer solution phase, said fuel, and an emulsifier;

providing a usable residual pressure from said initial pre-determined pressures following formation of said emulsion explosive; and utilizing said residual pressure to deliver said emulsion explosive to a pre-determined location without the need for additional pressure input once said emulsion explosive is formed.

2. The method of claim 1, wherein said fuel comprises a fuel phase, with said emulsifier being contained within said fuel and introduced into said emulsion manufacturing and delivery system via said fuel.

3. The method of claim 1, wherein said emulsifier is supplied directly into said emulsion manufacturing and delivery system at a pre-determined location to mix with said fuel and said oxidizer solution phase.

4. A method for manufacturing and delivering an emulsion explosive, said method comprising:

conveying an oxidizer solution phase into a mixing chamber at an initial pre-determined pressure;

conveying a fuel into said mixing chamber, also at an initial pre-determined pressure;

providing an emulsifier in said mixing chamber;

causing, non-mechanically and under influence of said initial pre-determined pressures, said fuel, at least a portion of said oxidizer solution phase, and said emulsifier to impinge one another with sufficient force to form an emulsion explosive, providing a usable residual pressure from said initial pre-determined pressures following formation of said emulsion explosive;

shearing, non-mechanically and under influence of said residual pressure, said emulsion explosive for further refinement purposes and to obtain a desired viscosity; and delivering, non-mechanically and under influence of said residual pressure, said emulsion explosive to a pre-determined location without the need for additional mechanical or pressure input once said emulsion explosive is formed.

5. The method of claim 4, wherein said providing an emulsifier in said mixing chamber comprises containing said emulsifier in said fuel, said fuel thus existing as a fuel phase, and thus said conveying a fuel comprises conveying a fuel phase into said mixing chamber.

6. The method of claim 4, wherein said providing an emulsifier in said mixing chamber comprises introducing said emulsifier at a pre-determined location, wherein said emulsifier is introduced directly in said mixing chamber.

7. The method of claim 4, wherein said conveying said oxidizer solution phase comprises conveying through a first nozzle.

8. The method of claim 7, wherein said conveying said fuel comprises conveying through a second nozzle, said first and second nozzles being counter-opposed to one another to effectuate said causing, non-mechanically, at least a portion of said oxidizer solution phase and said fuel to impinge on one another, in the presence of said emulsifier.

9. The method of claim 4, wherein said causing comprises conveying said oxidizer solution phase and said fuel simultaneously through a static mixer, in the presence of said emulsifier, to form said emulsion.

10. The method of claim 4, wherein said mixing chamber is configured with one or more stators or deflectors, and wherein said oxidizer solution phase and said fuel are caused to indirectly impinge one another, in the presence of said emulsifier, by deflecting off of said stators upon entering said mixing chamber.

11. The method of claim 4, further comprising conveying said emulsion into a second mixing chamber.

12. The method of claim 11, further comprising conveying a second portion of said oxidizer solution phase into said second mixing chamber.

13. The method of claim 12, further comprising causing, non-mechanically, said emulsion to impinge said second portion of said oxidizer solution phase to produce a more oxygen-balanced emulsion.

14. The method of claim 13, wherein said emulsion and said second portion of said oxidizer solution phases are caused to indirectly impinge one another by being deflected off of one or more stators existing within said second mixing chamber.

15. The method of claim 4, further comprising refining said emulsion prior to delivery.

16. The method of claim 15, wherein said refining comprises thickening and stabilizing said emulsion.

17. The method of claim 15, wherein said refining comprising sensitizing said emulsion by reducing its density.

18. A method for forming and delivering an emulsion explosive, said method comprising:

conveying an oxidizer solution phase through a first nozzle into a mixing chamber at an initial pre-determined pressure;

conveying a fuel phase through a second nozzle into said mixing chamber at an initial pre-determined pressure;

orienting said first and second nozzles in a counter opposed position, such that at least a portion of said oxidizer solution and fuel phases impinge on one another, under influence of said initial pre-determined pressures, with sufficient force to form a pre-blend emulsion in the presence of an emulsifier;

providing a usable residual pressure from said initial pre-determined pressures following formation of said pre-blend emulsion;

utilizing said residual pressure to force said pre-blend emulsion through a third nozzle;

utilizing said residual pressure to cause said pre-blend emulsion exiting from said third nozzle to impinge a second portion of said oxidizer solution phase being conveyed through a fourth nozzle, at an initial pre-determined pressure, with sufficient force to form a more oxygen-balanced emulsion, said pre-determined pressure from said second portion of said oxidizer solution phase contributing to said residual pressure;

forcing said pre-blend emulsion, under influence of said residual pressure, through a fifth nozzle to thicken and refine said emulsion;

shearing said emulsion, under influence of said residual pressure, to achieve a desired viscosity and to form an emulsion product ready for delivery; and utilizing said residual pressure to deliver said emulsion product to a pre-determined location without the need for additional mechanical or pressure input.

19. The method of claim 18, further comprising sensitizing said emulsion prior to said shearing by introducing a density-reducing agent therein.

20. The method of claim 19, wherein said sensitizing comprises introducing a trace element into said emulsion, wherein said trace element comprises one or more chemical gassing agents, which function to react to form a plurality of bubbles within said emulsion, thus reducing its density.

21. The method of claim 19, wherein said sensitizing comprises introducing a compressed gas into said emulsion, wherein said compressed gas functions to introduce a plurality of bubbles within said emulsion, thus reducing its density.

22. The method of claim 19, wherein said density-reducing agent is injected into said emulsion, and said density-reducing agent and said emulsion are conveyed through a sixth nozzle and caused to mix with one another.

23. The method of claim 19, wherein said density-reducing agent is injected into one of said oxidizer solution phase, said fuel phase, said emulsifier, and said mixing chamber.

24. The method of claim 18, further comprising placing a water ring around said emulsion to aid in said delivering to said pre-determined location.

25. The method of claim 18, wherein said steps of conveying are accomplished by one selected from the group consisting of a pump, a gravity delivery system, and a pressure vessel.

26. The method of claim 18, wherein said shearing is effectuated by one selected from the group consisting of a shear valve, a series of nozzles, and a combination of these.

27. The method of claim 18, wherein said pre-defined location is selected from the group consisting of a borehole, a receptacle, and a plant.

28. The method of claim 18, wherein said nozzles comprise a static mixer incorporated therein.

29. The method of claim 18, wherein said nozzles may comprise different sizes, depending upon system requirements.

30. A method for manufacturing and delivering an emulsion explosive, said method comprising:

providing a combined emulsion manufacturing and delivery system;

manufacturing an emulsion explosive within said emulsion manufacturing and delivery system under an influence of initial energy provided to supply one or more components of said emulsion explosive to said emulsion manufacturing and delivery system; and utilizing a residual energy remaining following said manufacturing of an emulsion explosive to deliver said emulsion explosive to a pre-determined location without the need for additional energy input.

* * * * *